US005237724A

United States Patent [19]

Lee

[11] Patent Number: 5,237,724

[45] Date of Patent: Aug. 24, 1993

[54] HINGE PIN SWING STOP

[76] Inventor: Byron Lee, 7920 San Felipe Blvd., Apt. 2005, Austin, Tex. 78729

[21] Appl. No.: 909,092

[22] Filed: Jul. 2, 1992

Related U.S. Application Data

[63] Continuation of Ser. No. 599,061, Oct. 17, 1990, abandoned.

[51] Int. Cl.[5] ..... E05D 11/06; E05D 5/10

[52] U.S. Cl. ..... 16/375; 16/386; 16/86 B

[58] Field of Search ..... 16/86 B, 375, 386

[56] References Cited

U.S. PATENT DOCUMENTS 1,616,265 2/1927 Kroehling ..... 16/375
3,187,372 6/1965 Parsons ..... 16/86 B
4,998,941 3/1991 Smith ..... 16/375

*Primary Examiner*—Lowell A. Larson
*Assistant Examiner*—Carmine Cuda
*Attorney, Agent, or Firm*—James F. Duffy

[57] ABSTRACT

A hinge pin swing stop which is coupled to the hinge pin of a door hinge or other hinged object and acts to limit the rotating swing of that object about the hinge. The swing stop can include a section which acts as the replacement hinge pin, a first extension which bears upon the solidly backed structure of a door or other object, and an angular extension which is brought into interfering contact with a structurally solid support to which the hinged object is attached. The point at which swing stopping interferences are encountered is selectedly adjustable.

4 Claims, 1 Drawing Sheet

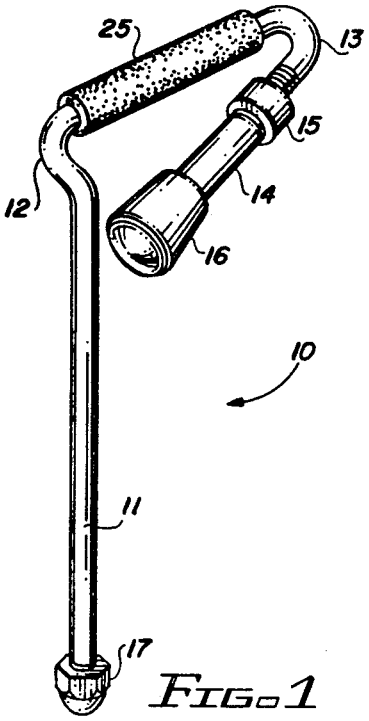
FIG. 1
FIG. 2
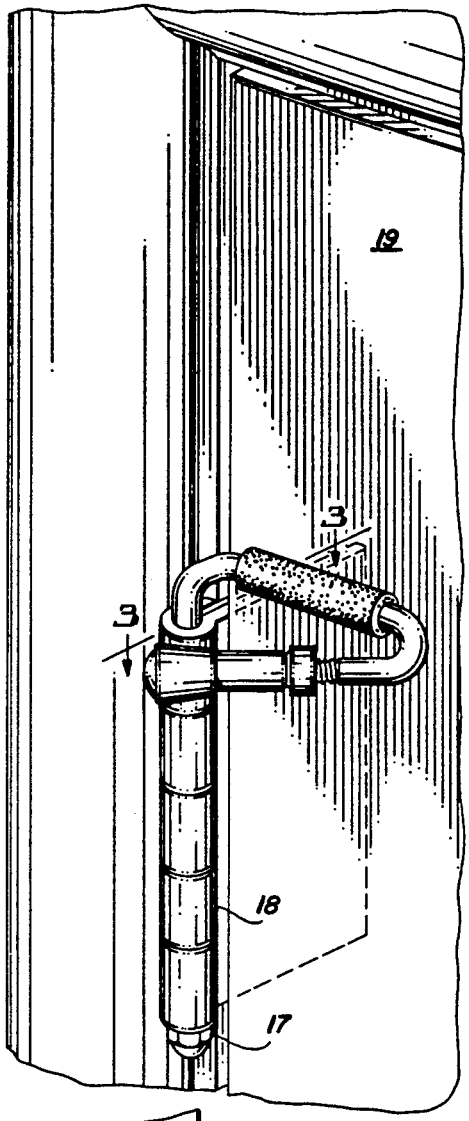
FIG. 4
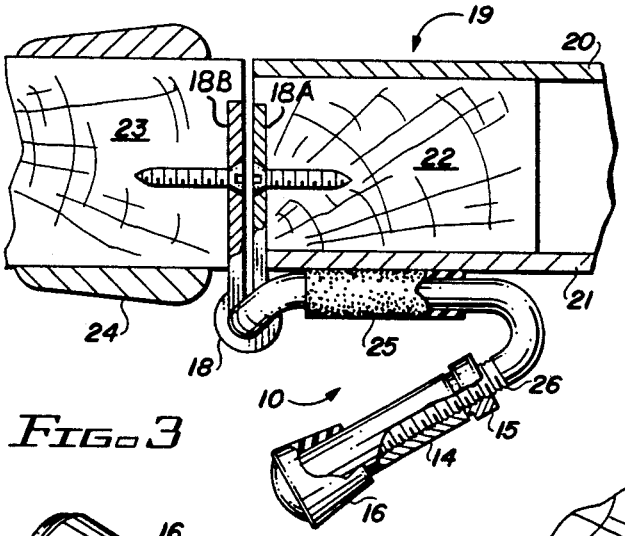
FIG. 3
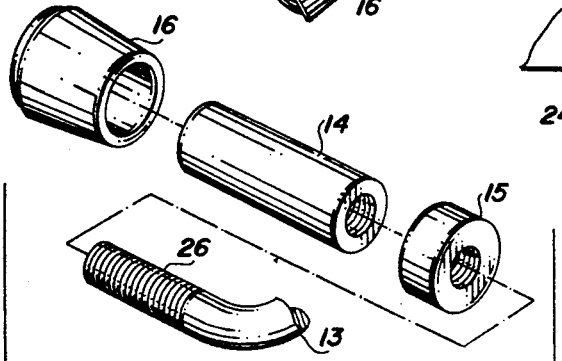
FIG. 5
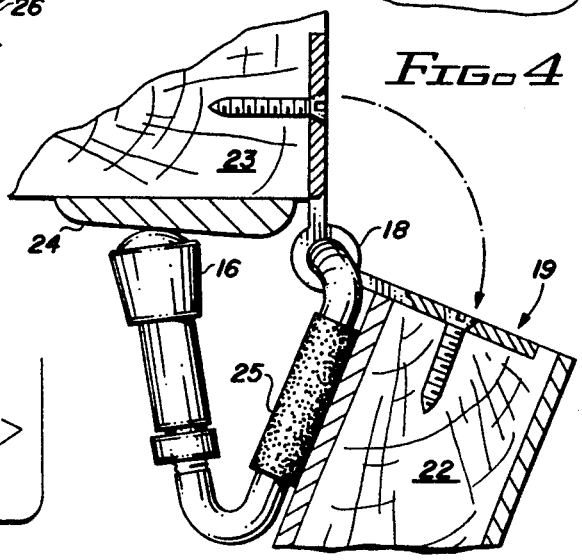

HINGE PIN SWING STOP

This application is a continuation of application Ser. No. 07/599,061, filed Oct. 17, 1990.

BACKGROUND

1. Technical Field of the Invention

The invention relates to the field of doorstop devices. Particularly, the invention relates to devices employed to limit the degree of hinged rotation of an object, such as a door, for example. Specifically, the invention in one embodiment is a device which is coupled to a hinge as a replacement for an existing hinge pin.

2. Prior Background Art

Hinged objects seem always subject to some form of restraint. Doors are locked to prevent them opening. Doors are limited in their movement to prevent them banging walls and furniture. Hinged desk tops are limited in movement from a closed position to a horizontal position. Upward swinging cabinet doors are restrained from freely closing. Hinged objects appear to invite restraint.

Hinged doors, especially, invite restraint. Like sentient beings, some doors stubbornly refuse to remain open; others, to remain closed. Some appear to take pleasure in slamming into furniture or wall hangings, or bashing their door knobs jarringly into a plastered wall. The prior art is replete with devices intended to limit the extent a door will rotate about its hinged support.

Small bumpers are often placed on the floor to interfere with passage of the door's base past the bumper. Cleaning the floor around a permanently installed bumper can be a problem.

Coiled springs having a bumper at one end and a screw fastener at the other are fastened to either a wall or the door to prevent the door contacting the wall. A hole in the wall or the door is the usual result of this arrangement.

Another popular door swing restraint in generally wye shaped, having a bore in the base of its stem for receiving the hinge pin of the door hinge coupled to the door to be restrained. When the hinge pin is placed through the bore at the base of the wye shape, and the pin replaced in the hinge, the arms of the wye shape lie in a generally horizontal plane such that, as the door is opened toward its limits, the surface of the door will contact one arm of the wye while the surface of the wall contacts the other arm of the wye. To buffer the contact force, a rubber bumper is placed at the end of each arm of the wye. Unfortunately, the usual result, again, is a hole in the wall, the door, or both.

The last two devices described cause damage to wall and door because they are so often installed in a manner which causes high pressure concentration on small areas of plaster wall or hollow-core door surfaces. The last device, the wye shaped device, has the advantage of being simple to install. However, the resulting damage which accrues from its use, makes it generally undesirable.

It is an object of the invention to provide a hinge pin swing stop for limiting the degree of rotation of an object, which swing stop can be used without incurring pressure induced damage to adjacent surfaces.

SUMMARY DESCRIPTION OF THE INVENTION

The invention is disclosed and claimed as the improvement in a hinge having two hinge plates coupled for rotation about a hinge pin. A first of the hinge plates is coupled to a support. The second of the two hinge plates is coupled to an object to be hingedly rotated about the support. The improvement is made up of a hinge pin swing stop for limiting the degree of hinged rotation of the object. In a first embodiment of the invention, the swing stop, in turn, comprises a shaft, for rotatingly coupling the two hinge plates, as a replacement for the hinge pin, the shaft having a first end extending beyond the two hinge plates.

The first end comprises an extension of the shaft and has first and second defined regions and a distal end. The first defined region has the axis of the shaft extension generally parallel to a surface of either one of the object and the support. The second defined region has the axis of the shaft extension angularly disposed, again, with respect to the surface of one or the other of the object and the support. The distal end terminates the second defined region.

With the improvement, the degree of hinged rotation of the object is limited by interfering contact of the first defined region and the surface of, for example, the object and the simultaneous interfering contact of the distal end with the surface of support, respectively.

The second defined region has a selected length and includes means for selectedly adjusting that length. Thus, the degree of hinged rotation of the object may be selectedly determined by adjusting the length of the second defined region.

The invention may also be described as means for limiting the rotational swing of an object, the object being hinged to a support. The rotational swing limiting means comprises a Vee shaped swing element which has first and second arms. The first arm has a distal end which is coupled to the hinge pin of the hinge, which couples the object to the support. The second arm of the Vee shaped element also has a distal end. In this case, the end makes interfering contact with the support to which the object is hinged. The first arm will lie generally parallel to and make interfering contact with the surface of the object which is hinged to the support when the end of the second arm comes into interfering contact with the support itself. So that the degree to which the swing of the object will be established, the length of the second arm of the Vee shaped element is adjustably controlled.

BRIEF DESCRIPTION OF THE DRAWINGS

FIG. 1 is a top, front perspective view of the hinge pin swing stop of the invention.

FIG. 2 is a top, front perspective view of the invention installed as a hinge pin replacement in a hinge mounted on the left side of a door.

FIG. 3 is a plan view of the invention in place in a hinge and contacting the solidly framed portion of a hollow core door.

FIG. 4 is a plan view of the invention in place in a hinge and contacting both the solidly framed portion of a door as well as the molding-strip protected surface of a wall.

FIG. 5 is an exploded assembly drawing of the adjustable end-length portion of the invention.

NOTE: It may be of interest to observe that, by rotating the sheet of drawings through one hundred eighty degrees, FIGS. 1-4 may be taken as presenting a fair representation of the use of the invention with a door having a hinge on its right side, when viewed from below.

DETAILS OF BEST MODE FOR CARRYING OUT THE INVENTION

For purposes of promoting an understanding of the principles of the invention, reference will now be made to the embodiments illustrated in the drawings and specific language will be used to describe same. It will nevertheless be understood that no limitations of the scope of the invention is thereby intended, there being contemplated such alterations and modifications of the illustrated device, and such further applications of the principles of the invention as disclosed herein, as would normally occur to one skilled in the art to which the invention pertains.

A first embodiment of the invention, a hinge pin swing stop, is illustrated in FIG. 1 and bears the reference 10. It is comprised of a hinge pin replacement shaft 11. In use, shaft 11 replaces the hinge pin in a hinge associated with a hinged object whose hinged rotation is to be limited.

The top of shaft 11 is Vee shaped, the Vee lying in a plane generally at right angles to a plane containing shaft 11. Curved region 12 leads from shaft 11 into a first, padded leg 25 of the Vee shape. A second leg 13 has thread coupled to it a length extending ferrule 14 and a locking nut 15. Ferrule 14 is terminated with a shock absorbing bumper 16. A decorative nut 17 caps the lower end of shaft 11, in the illustration of FIG. 1. In a second embodiment of the invention, not shown, the Vee shape and shaft 11 may be separable elements.

FIG. 2 shows a door 19 hinged along its left edge. The attachment of hinge 18 to door 19 is best illustrated in FIG. 3. Door 19 has a frame made up of solid structural elements as, for example, element 22. The surfaces of door 19 are made up of thin veneer sheets 20 and 21, known as door skins. Hinge 18 has 2 hinge plates, 18A and 18B, respectively. Hinge plate 18A is screw fastened to a solid structural element 22 within the generally hollow core of door 19 thin veneer surfaces 20 and 21. Hinge plate 18B is screw fastened to the solid structural element 23 used for fabricating the structural support for door 19. The original hinge pin of hinge 18 (not shown) has been removed from hinge 18 and the shaft 11 of the hinge pin swing stop 10 has been substituted therefor.

With the swing stop 10 installed as illustrated in FIGS. 2, 3, and 4, padded leg 25 lies adjacent to and generally parallel to the surface of door 19 and approximate the solid structural element 22 within door 19. Leg 13 lies in a plane generally perpendicular to that of the surface of door 19 and is angularly disposed away from the surface of that door.

When door 19 is opened, as shown in FIG. 4, contact of padded leg 25 with the veneer surface of door 19 will be maintained and, thus, leg 13 will be rotated about shaft 11, acting as the pin of hinge 18, so as to bring shock absorbing bumper 16 into interfering contact with decorative molding 24.

Decorative molding 24 is backed by the solid structural element 23 to which hinge plate 18B is attached. Because of the solid structure involved, the impact of bumper 16 with decorative molding 24 will cause no damage to decorative molding 24. This is true even if there is a layer of plasterboard between molding 24 and support structure 23.

With the swing stop 10 in the position illustrated in FIG. 4, interfering forces are exerted on molding 24 by shock absorbing bumper 16 and on door 19 by padded arm 25. Padded arm 25 directs its force inwardly against the solid structural element 22 of door 19 and, again, no damage is caused to the veneer surface of hollow core door 19.

The degree to which door 19 may be opened is determined by the length of leg 13 of swing stop 10. To this end, the length of leg 13 is made selectedly adjustable. The adjustment in length of leg 13 is achieved by thread-coupling a ferrule 14 to threads 26 on leg 13. To provide a positive locking device, lock nut 15 is provided to be tightened against ferrule 14 at the position selected by the user. The distal end of ferrule 14 is covered with the protective, shock absorbing bumper 16.

What has been disclosed is a hinge pin swing stop which is coupled to the hinge pin of a door hinge or other hinged object and acts to limit the rotating swing of that object about the hinge. The swing stop can include a section which acts as the replacement hinge pin, a first extension which bears upon the solidly backed structure of a door or other object, and an angular extension which is brought into interfering contact with a structurally solid support to which the hinged object is attached. The point at which swing stopping interferences are encountered is selectedly adjustable.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, that which is claimed is:

1. In a hinge having two hinge plates coupled for rotation about a hinge pin, a first of said hinge plates being coupled to a support, a second of said hinge plates being coupled to an object to be hingedly rotated about said support, the improvement comprising:

a hinge pin swing stop for limiting the degree of hinged rotation of said object, said swing stop comprising:

a shaft, for rotatingly coupling said two hinge plates, as a replacement for said hinge pin, said shaft extending beyond said two hinge plates and being there bent into a Vee shape;

said Vee shape having first and second defined regions and a distal end;

said first defined region being a first leg of said Vee shape extending adjacent and generally parallel to a surface of at least one of said object and said support, for receiving and distributing contact forces, as may be induced between said surface and said first leg of said Vee shape, along the length of said first leg; and said second defined region being a second leg of said Vee shape angularly disposed with respect to said surface of said at least one of said object and said support, said distal end terminating said second defined region;

whereby the degree of hinged rotation of said object is limited by interfering contact distributed along the length of said first leg of said Vee shape and said surface of said at least one of said object and said support and the simultaneous interfering contact of said distal end with said surface of said at least one of said support and said object, respectively, and high pressure concentration of forces on small areas is avoided by so distributing contact forces along said first leg of said Vee shape.

2. The improvement of claim 1 wherein said second defined region has a selected length and further comprises means for selectedly adjusting said length, whereby the degree of hinged rotation of said object may be selectedly determined by adjusting said length.

3. In a hinge having two hinge plates coupled for rotation about a hinge pin, a first of said hinge plates being coupled to a support, a second of said hinge plates being coupled to an object to be hingedly rotated about said support, the improvement comprising:

a hinge pin swing stop for limiting the degree of hinged rotation of said object, wherein said hinge plates further comprise a hinge pin rotatingly coupling said hinge plates, said object comprises a hollow core door having thin veneer surfaces covering interior structural elements said thin veneer surfaces define front and back door surfaces, and said swing stop further comprises:

a Vee shaped swing stop element having first and second arms;

said first arm having a selected extended length and a distal end coupled to said hinge pin;

said second arm having a distal end for interferingly contacting said support, said distal end being terminated by a shock absorbing bumper;

said selected extended length of said first arm lying generally parallel to and distributing along said extended length interfering contact with said thin veneer surface of said door above a said interior structural element when said bumper terminating said distal end of said second arm is in interfering contact with said support;

whereby high pressure concentration of forces on small areas of said thin veneer surface of said door is avoided by distributing contact forces on said veneer surface along substantially the entire selected extended length of said first arm of said Vee shape and above said interior structural element.

4. The improvement of claim 3 further comprising means coupled to said second arm for adjustably controlling the length of said second arm to establish the limits of the rotational swing of said door hinged to the support.

* * * * *